US010100458B2

(12) United States Patent
Stewart

(10) Patent No.: US 10,100,458 B2
(45) Date of Patent: Oct. 16, 2018

(54) HEATED STORAGE RACK

(71) Applicant: Little Locker Room LLC, Oakdale, MN (US)

(72) Inventor: Chad Alonzo Stewart, Oakdale, MN (US)

( * ) Notice: Subject to any disclaimer, the term of this patent is extended or adjusted under 35 U.S.C. 154(b) by 0 days.

(21) Appl. No.: 15/606,725

(22) Filed: May 26, 2017

(65) Prior Publication Data

US 2017/0342640 A1 Nov. 30, 2017

Related U.S. Application Data

(60) Provisional application No. 62/341,741, filed on May 26, 2016.

(51) Int. Cl.

| | |
|---|---|
| ***D06F 57/00*** | (2006.01) |
| ***A47B 81/00*** | (2006.01) |
| ***A47B 47/00*** | (2006.01) |
| ***A63B 71/00*** | (2006.01) |

(52) U.S. Cl.

CPC ..... *D06F 57/00* (2013.01); *A47B 47/00* (2013.01); *A47B 81/00* (2013.01); *A63B 71/0036* (2013.01)

(58) Field of Classification Search

CPC ..... A47B 47/00; A63B 71/0036; D06F 57/00

(Continued)

(56) References Cited

U.S. PATENT DOCUMENTS 2,975,529 A * 3/1961 Weber ..... A47K 10/06 206/216
3,089,327 A * 5/1963 Stilwell, Jr. ..... D06F 29/02 68/139

(Continued)

FOREIGN PATENT DOCUMENTS

CN 2364748 2/2000
CN 2656466 11/2004

(Continued)

OTHER PUBLICATIONS

2017 Multi Function Double Dryer Electric Clothes Airer Rapid Clothes Dryer 3 Layer Large Capacity, Sterilization, Clothes Dryer, Dryer Clothes from Lilypyq, Dhgate.com, http://www.dhgate.com/product/multi-function-double-dryer-electric-clothes/372354483.html, printed Apr. 11, 2017.

Low Noice Electricity Saving does not hurt clothes large capacity clothes dryer retractable clothes dryer rack-in Clothes Dryers from Home Improvement on Aliexpress.com, Alibaba Group, https://www.aliexpress.com/item/Low-noise-electricity-saving-does-not-hurt-clothes-large-capacity-clothes-dryer-retractable-clothes-dryer-rack/32761207447.html?spm=2114.40010308.4.7.ykQsMO, printed Apr. 11, 2017.

*Primary Examiner* — Stephen M Gravini
(74) *Attorney, Agent, or Firm* — Merchant & Gould P.C.

(57) ABSTRACT

A storage and drying container for storing and drying outerwear, sports clothing or equipment is provided. The unit comprises an enclosure having a back wall, a front wall, a top wall, and two side walls defining the internal storage portion of the container. The container may also include shelf members for supporting the outerwear, sports clothing or equipment. The shelf members may optionally include holes for allowing for air circulation throughout the container in order to facilitate the drying of the outerwear, sports clothing or equipment placed in the chamber. Further the design of the drying container is such that sports equipment may remain in a bag, such as a hockey bag, thereby allowing for easy storage and drying prior to the next use. The container may be provided with a heating element and drying fan to encourage airflow to facilitate drying and temperature uniformity throughout the container.

18 Claims, 11 Drawing Sheets

(58) Field of Classification Search
USPC ..... 34/239
See application file for complete search history.

(56) References Cited

U.S. PATENT DOCUMENTS

| | | | | | |
|---|---|---|---|---|---|
| 3,577,650 | A * | 5/1971 | Brahm | D06F 58/14 | 219/386 |
| 4,625,432 | A * | 12/1986 | Baltes | A61L 2/06 | 34/196 |
| 4,873,773 | A * | 10/1989 | Canonge | D06F 58/14 | 34/622 |
| 5,211,460 | A * | 5/1993 | Liu | A47B 61/04 | 211/121 |
| 5,592,750 | A * | 1/1997 | Eichten | D06F 59/02 | 223/70 |
| 6,018,885 | A * | 2/2000 | Hill | D06F 58/10 | 34/202 |
| 6,256,905 | B1 * | 7/2001 | White | A23L 3/34095 | 34/218 |
| 6,263,591 | B1 * | 7/2001 | La Porte | F26B 9/003 | 219/386 |
| 6,308,437 | B1 * | 10/2001 | Villar | A24F 25/02 | 34/210 |
| 6,392,201 | B1 * | 5/2002 | Owens | A47J 39/00 | 219/387 |
| 6,928,745 | B2 * | 8/2005 | Lickiss | D06F 58/04 | 34/104 |
| 7,152,614 | B2 * | 12/2006 | Kalnay | E04B 1/34305 | 135/128 |
| 7,913,419 | B2 * | 3/2011 | Tomasi | D06F 29/00 | 211/85.3 |
| 8,286,452 | B2 * | 10/2012 | Kendall | D06F 39/12 | 108/64 |
| 8,404,179 | B2 * | 3/2013 | Antinozzi | A61L 2/18 | 422/292 |
| 8,726,534 | B2 * | 5/2014 | Chappell | F26B 9/003 | 206/315.1 |
| 8,793,894 | B2 | 8/2014 | Bo | | |
| 8,898,925 | B2 * | 12/2014 | Zimmerman | F26B 21/06 | 34/105 |
| 9,015,955 | B2 * | 4/2015 | Vezina | D06F 58/14 | 211/182 |
| 9,322,124 | B1 * | 4/2016 | Al-Hasan | D06F 58/10 | |
| 9,833,524 | B2 * | 12/2017 | Mauzerall | A61L 2/07 | |
| 2002/0056470 | A1 * | 5/2002 | Huot | B08B 3/045 | 134/95.2 |
| 2008/0222909 | A1 * | 9/2008 | Picozza | D06F 58/14 | 34/195 |
| 2008/0252189 | A1 | 10/2008 | Regan | | |
| 2017/0342640 | A1 * | 11/2017 | Stewart | D06F 57/00 | |

FOREIGN PATENT DOCUMENTS

| | | | | |
|---|---|---|---|---|
| CN | 106263642 | | 1/2017 | |
| GB | 405748 | A * | 2/1934 | D06F 45/00 |
| JP | 04227211 | A * | 8/1992 | |
| KR | 20130133958 | A * | 12/2013 | |

* cited by examiner

HEATED STORAGE RACK

CROSS REFERENCE TO RELATED APPLICATIONS

This application claims the benefit of U.S. Provisional Application No. 62/341,741, filed, May 26, 2016, which is hereby incorporated by reference in its entirety.

INTRODUCTION

Lockers for storing athletic equipment are well-known in the art. Sports equipment is generally composed of fabric and plastic components which are not machine washable. When the equipment becomes wet from perspiration, the equipment must be dried in order to reduce or eliminate the growth of mildew and bacteria. In addition, the wet equipment can also be malodorous. Thus, many types of drying stands and racks have been proposed in the past for the sports equipment to be hung on to permit it to dry. However, these drying racks are classical for in-home use. Thus, using the drying rack requires that equipment must be brought into bedrooms or closets, where the malodorous sports equipment must be stored in the living space while drying.

In addition to drying racks, specialized lockers have been proposed for the purpose of containing such sports clothing and equipment, as set out in the following examples. One version of a locker is disclosed in U.S. Pat. No. 4,974,524. However, while this design is an improvement over prior sports lockers due to its open air design, it is still largely unsuitable for locations of a house lacking in sufficient air circulation. Since the shelves of this locker are of a solid construction, they block any air flow up or down through the locker. Wet clothing and/or sports equipment placed inside the locker will still remain moist for quite some time before the moisture evaporates and the contents dry. Thus bacterial and mold formation and the resulting foul odors are still a problem with designs of this type.

There have been prior attempts to create an air flow in lockers or to remove foul odors from lockers. For example, in U.S. Pat. No. 5,664,997, there is disclosed an apparel equipment locker incorporating contamination and toxic materials extraction and evacuation system. However, lockers of this type require complicated ducting and venting paths to be built into the building and connected to the locker and are difficult and expensive to install. Moreover, the lockers are designed to be hermetically sealed so that inside air can be actively sucked out and passively replaced with outside air through separate pipes.

As another example, U.S. Pat. No. 6,889,449 discloses a sanitizing cabinet for sports equipment. This design incorporates a system of fans for circulating ozone containing gas inside a closed cabinet. These cabinets are also intended to be hermetically sealed to prevent ozone from seeping from inside the cabinet into the room. Moreover, sanitizing cabinets of this sort are intended to be used on a commercial basis for sanitizing sports equipment and are not suitable for home use, such as storing sports clothing and equipment in a bedroom or walk-in closet.

It is also known in the art, as shown in U.S. Pat. No. 5,369,892, that one may use self-contained dryers for accommodating sports equipment. The dryers have walls which cause heated air to circulate in the drying chambers to decrease the moisture content of the air and increase the drying energy efficiency. Blowers and fans associated with electric heaters operate to circulate heated air through the drying chambers. However, such drying cabinets are similarly not intended to store and dry sports clothing and equipment in their bedroom. Further, this type of self-contained dryer is not manufactured in a manner that will allow for drying in cold temperatures.

It is also known that, for example in US 2008/0252189, that storage units such as lockers and, more particularly, to lockers for storing outerwear, sports clothing, equipment and accessories. This storage unit prevents moisture associated with recently worn outerwear, sports clothing and sports equipment from encouraging the growth of bacteria and mold which tend to generate foul odors. The device encourages rapid drying of sweat and other moisture. However, this unit requires that the storage unit be in a location with an ambient temperature similar to the inside of a home. Thus, this storage locker cannot function in a garage, unheated storage facility or outdoors. Thus, this type of self-contained dryer is not manufactured in a manner that will allow for drying in cold temperatures because the heating element does not include both radiant and conductive heat.

A problem with such prior inventions is that they are generally not designed to provide a low level heat within an enclosed area to allow for equipment to dry over the period of 4-12 hours. Furthermore, there is no container described in the prior art that is able to be used in unheated rooms and storage spaces under cold weather conditions.

Heated Storage Rack

A storage and drying container for storing and drying outerwear, sports clothing or equipment is provided. The unit comprises an enclosure having a back wall, a front wall, a top wall, and two side walls defining the internal storage portion of the container. The container may also include shelf members for supporting the outerwear, sports clothing or equipment. The shelf members may optionally include holes for allowing for air circulation throughout the container in order to facilitate the drying of the outerwear, sports clothing or equipment placed in the chamber. Further the design of the drying container is such that sports equipment may remain in a bag, such as a hockey bag, thereby allowing for easy storage and drying prior to the next use. The container may be provided with a heating element and drying fan to encourage airflow to facilitate drying and temperature uniformity throughout the container.

DETAILED DESCRIPTION

Figure 1:
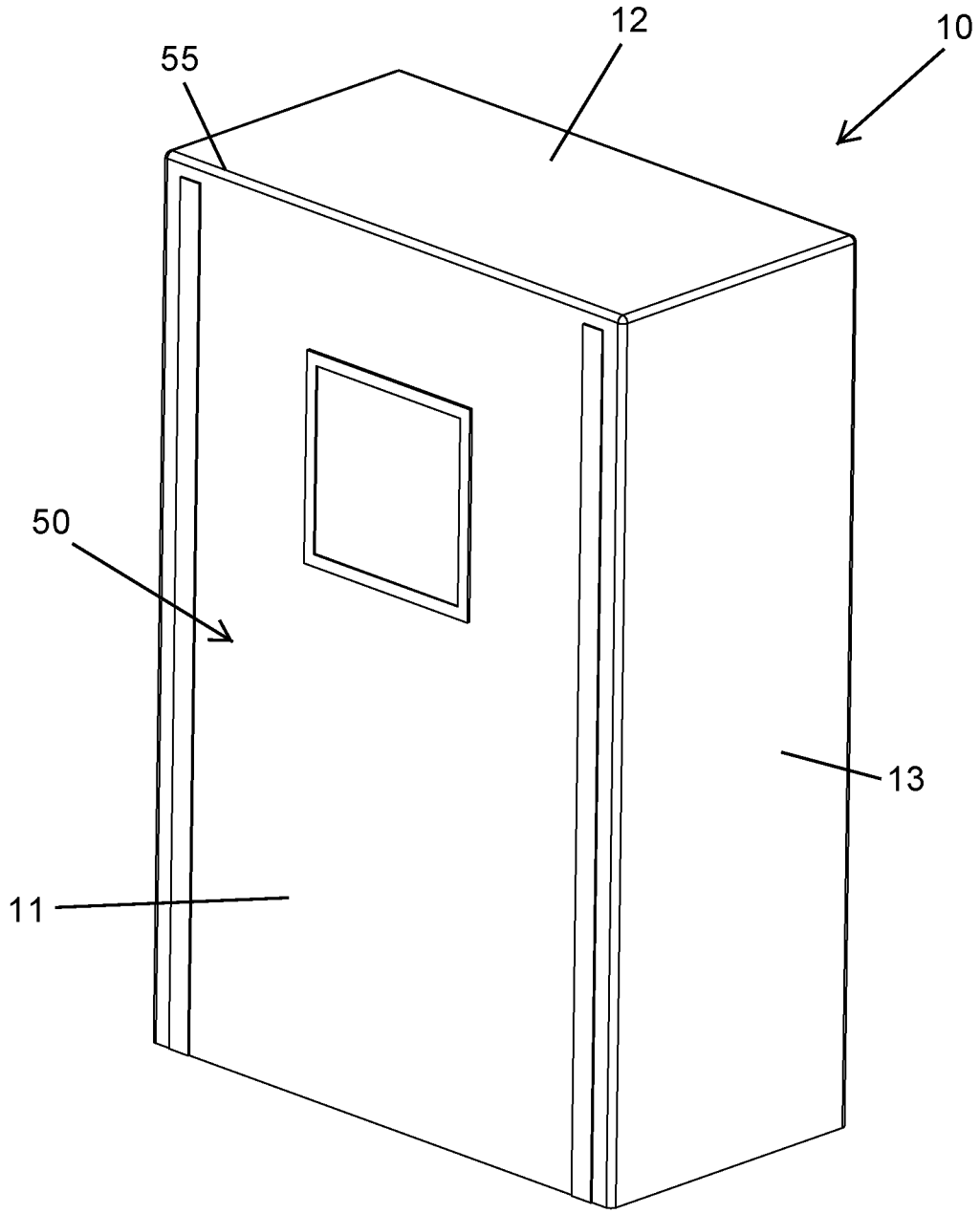
FIG. 1 is a top front perspective view of a first embodiment of the drying container.
Figure 2:
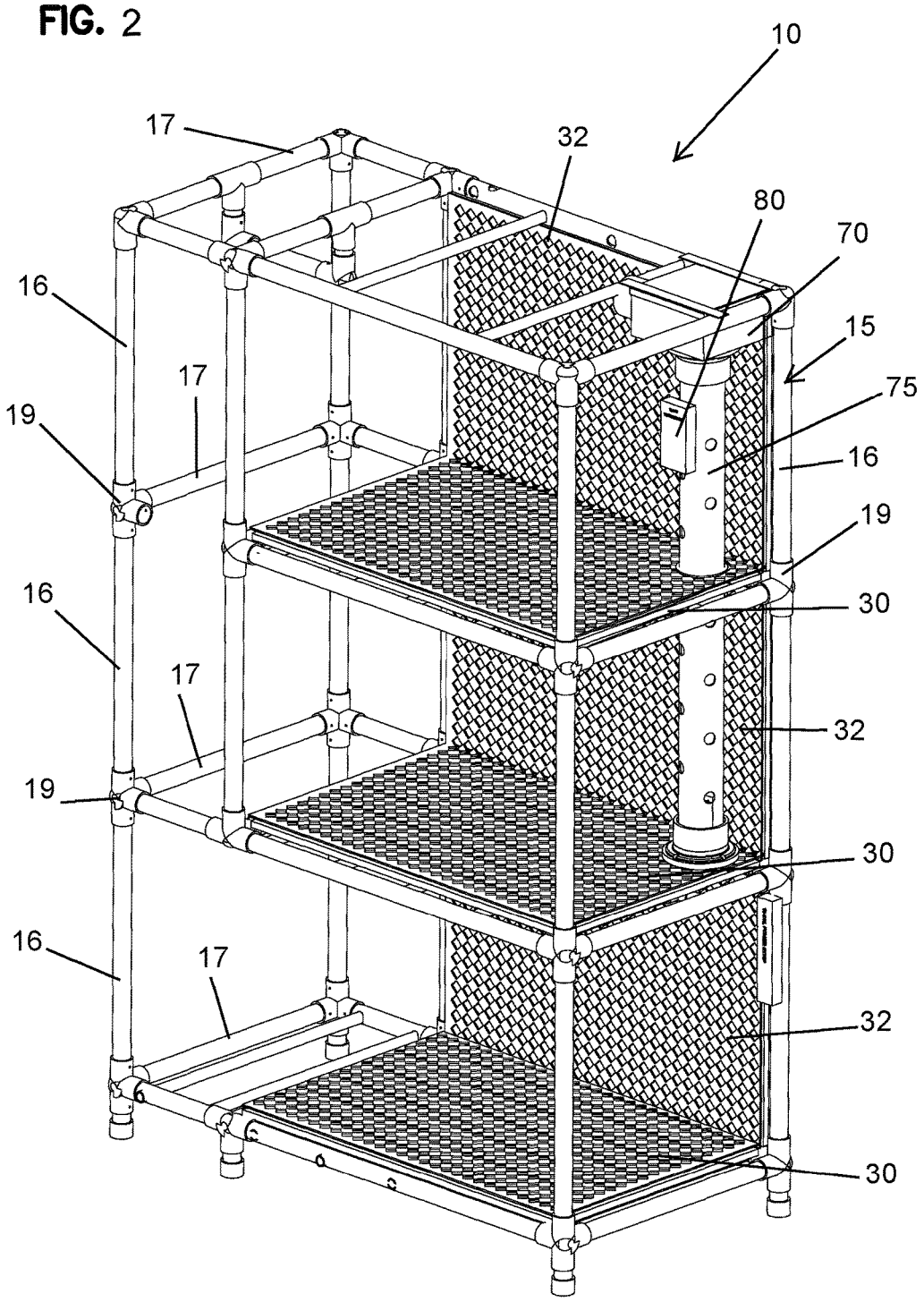
FIG. 2 is a top front perspective view of FIG. 1 where the cover is removed.
Figure 3:
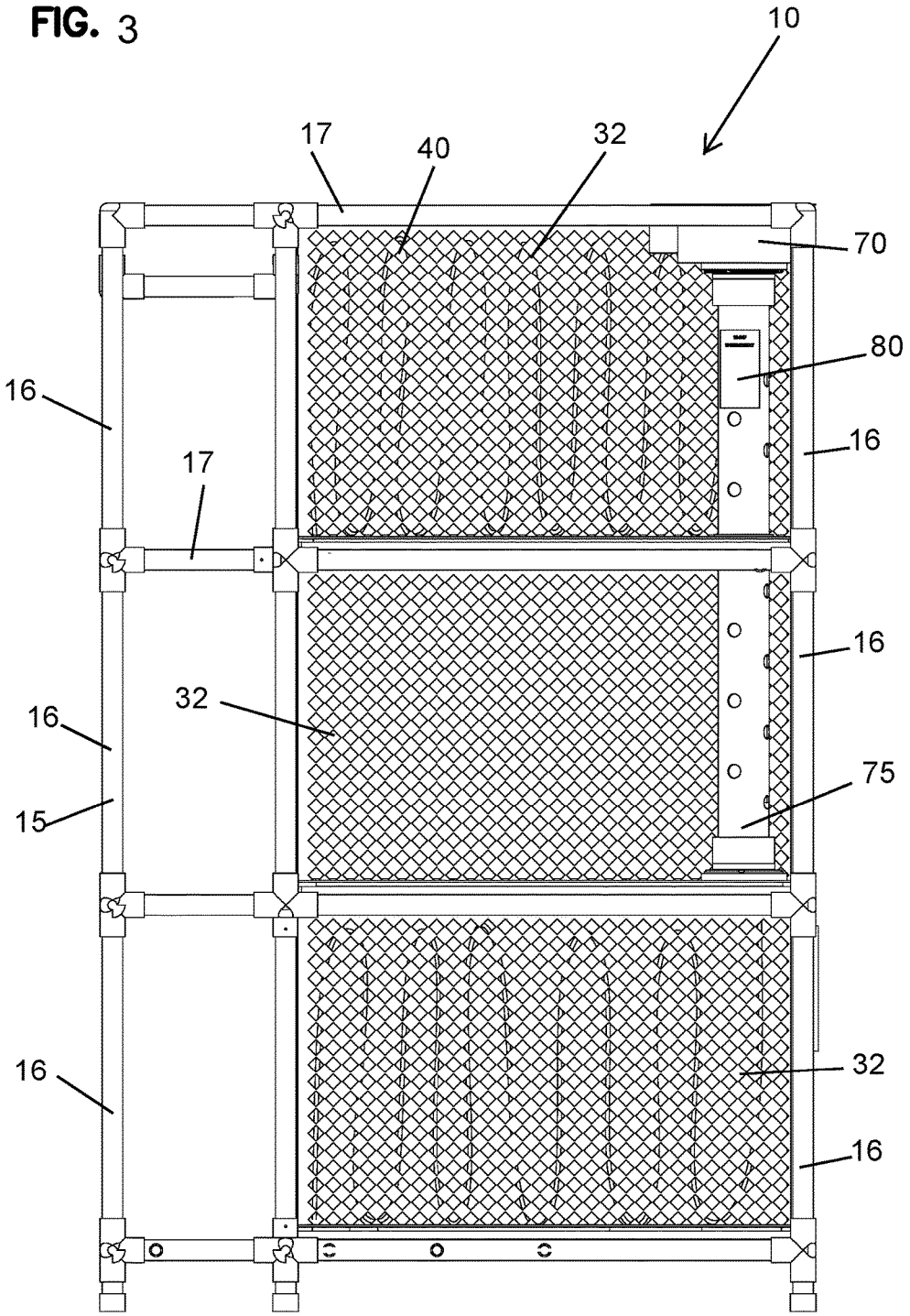
FIG. 3 is a front elevation view of FIG. 1 where the cover is removed.

Referring now to the drawings, wherein the storage container 10, generally comprises a frame 15; at least one panel 30, thereby forming a shelf; a heating element 40; and a cover 50 sized, to fit over the frame thereby forming an internal compartment.

Figure 7:
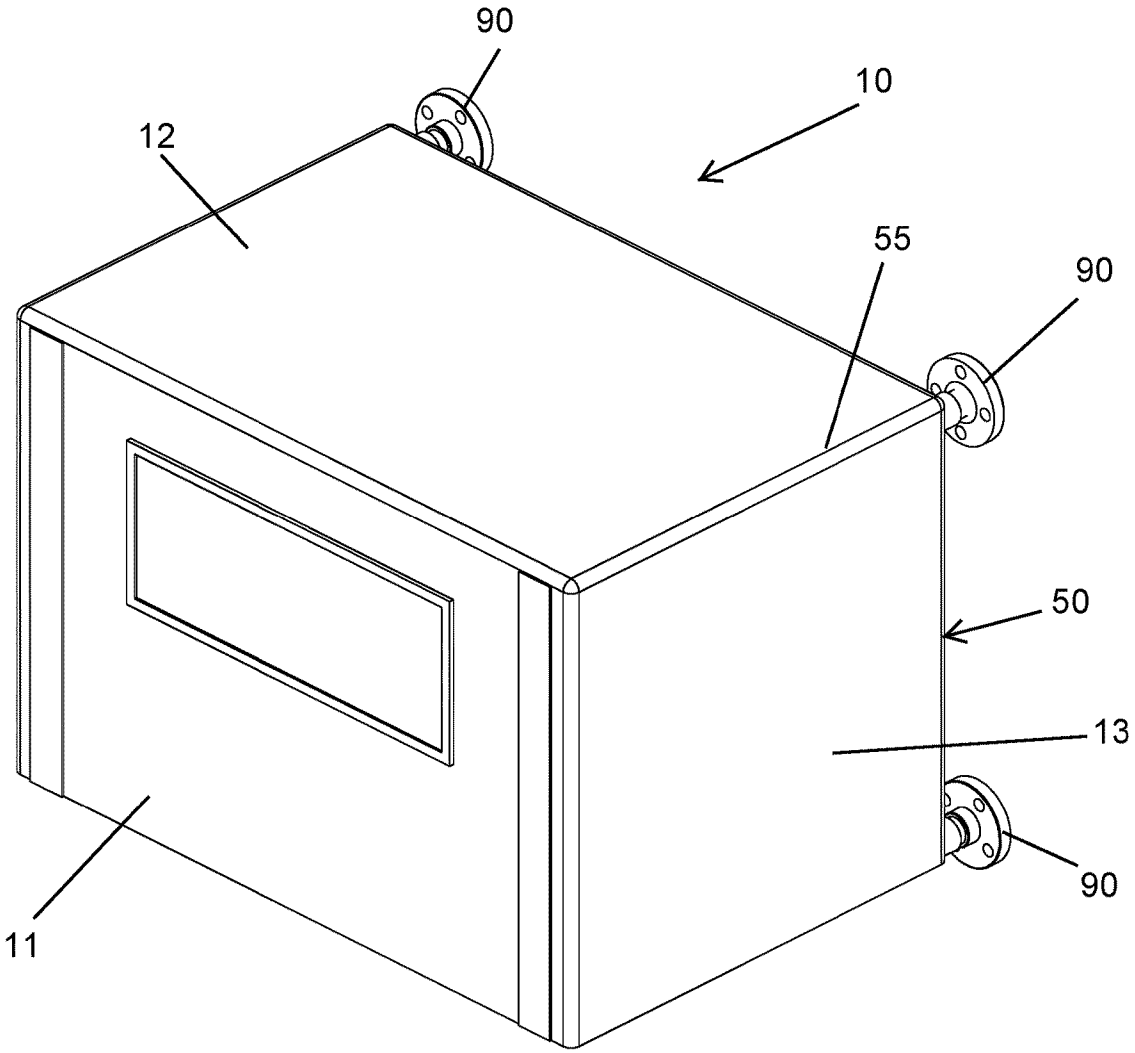
FIG. 7 is a top front perspective view of a second embodiment of the drying container.
Figure 8:
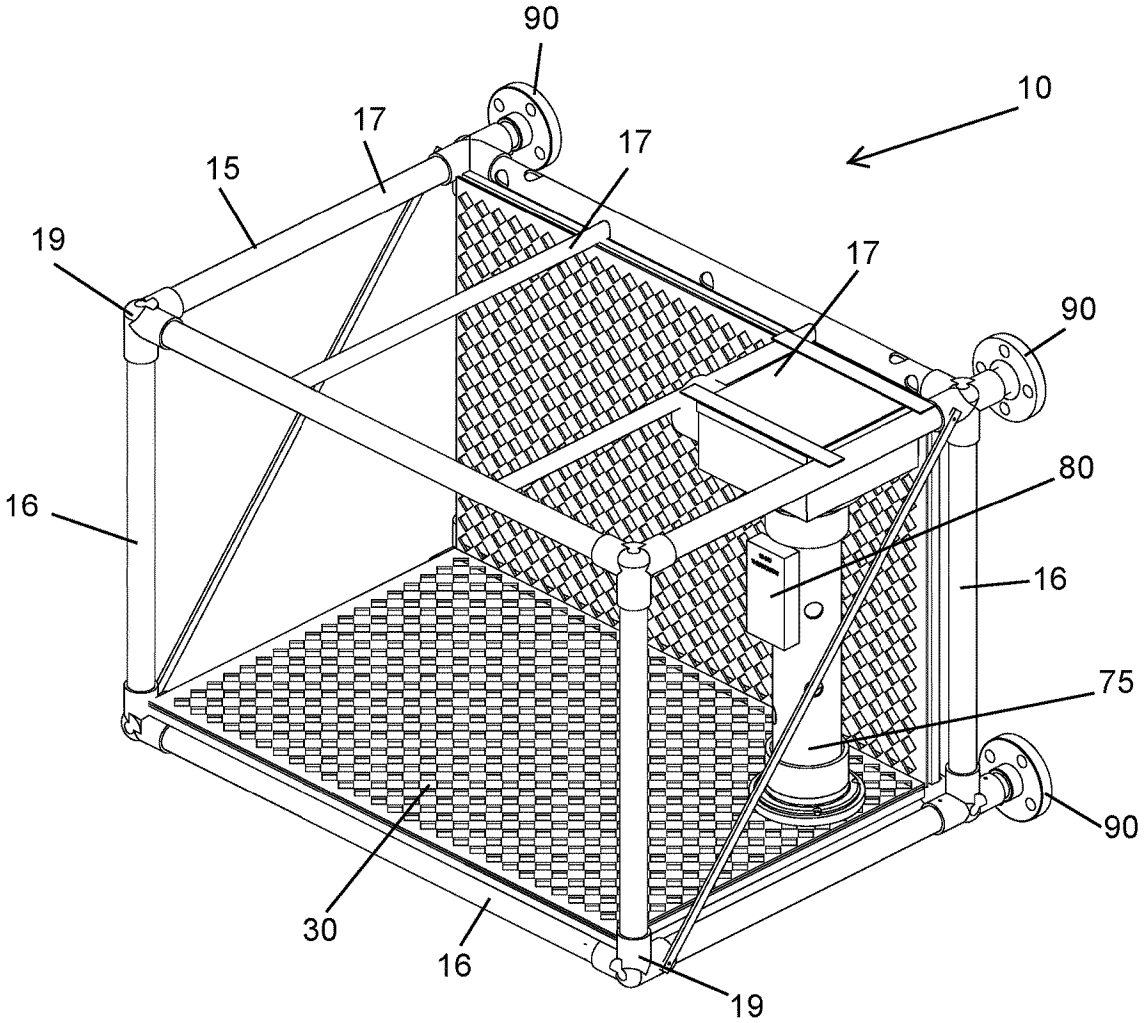
FIG. 8 is a top front perspective view of FIG. 7 where the cover is removed.
Figure 9:
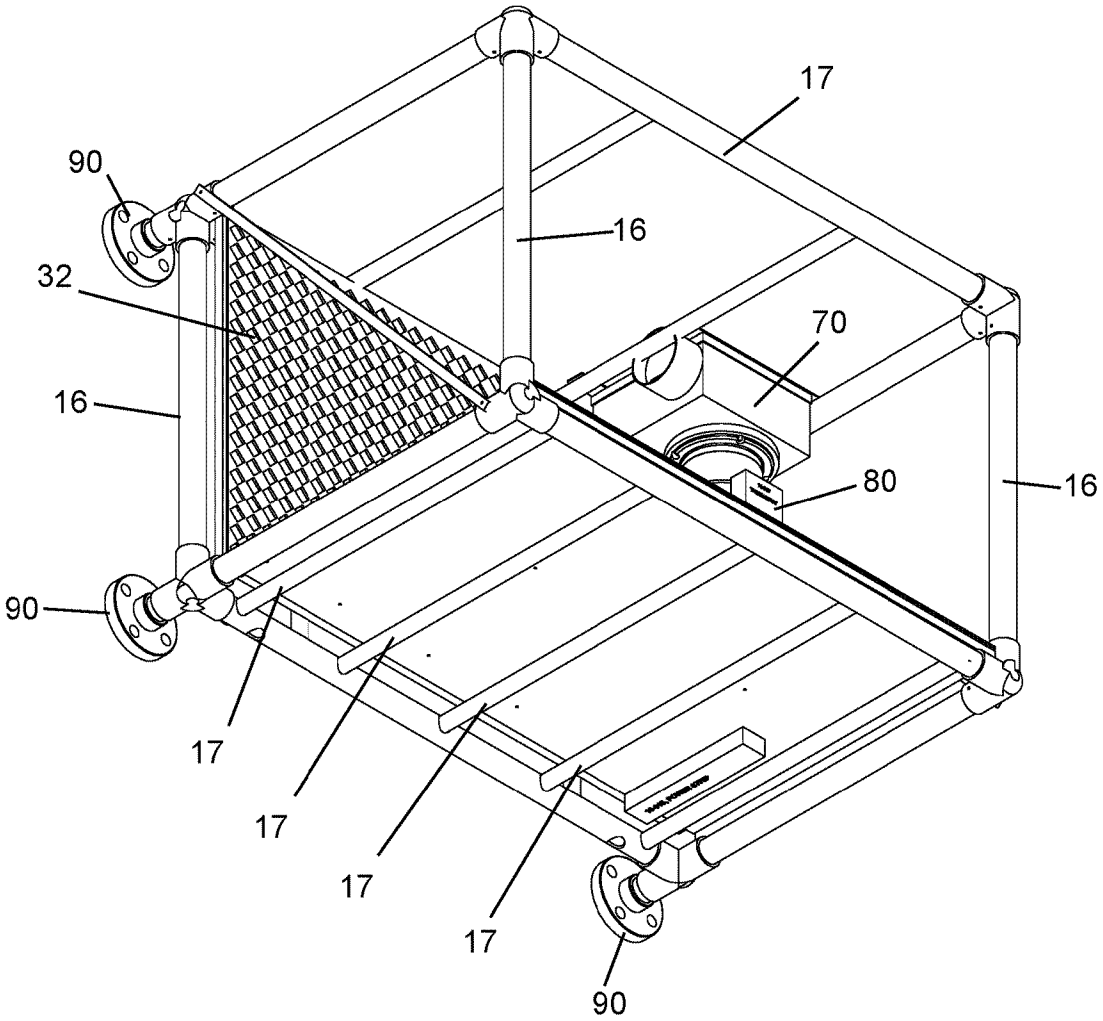
FIG. 9 is a bottom front perspective view of FIG. 7 where the cover is removed.
Figure 10:
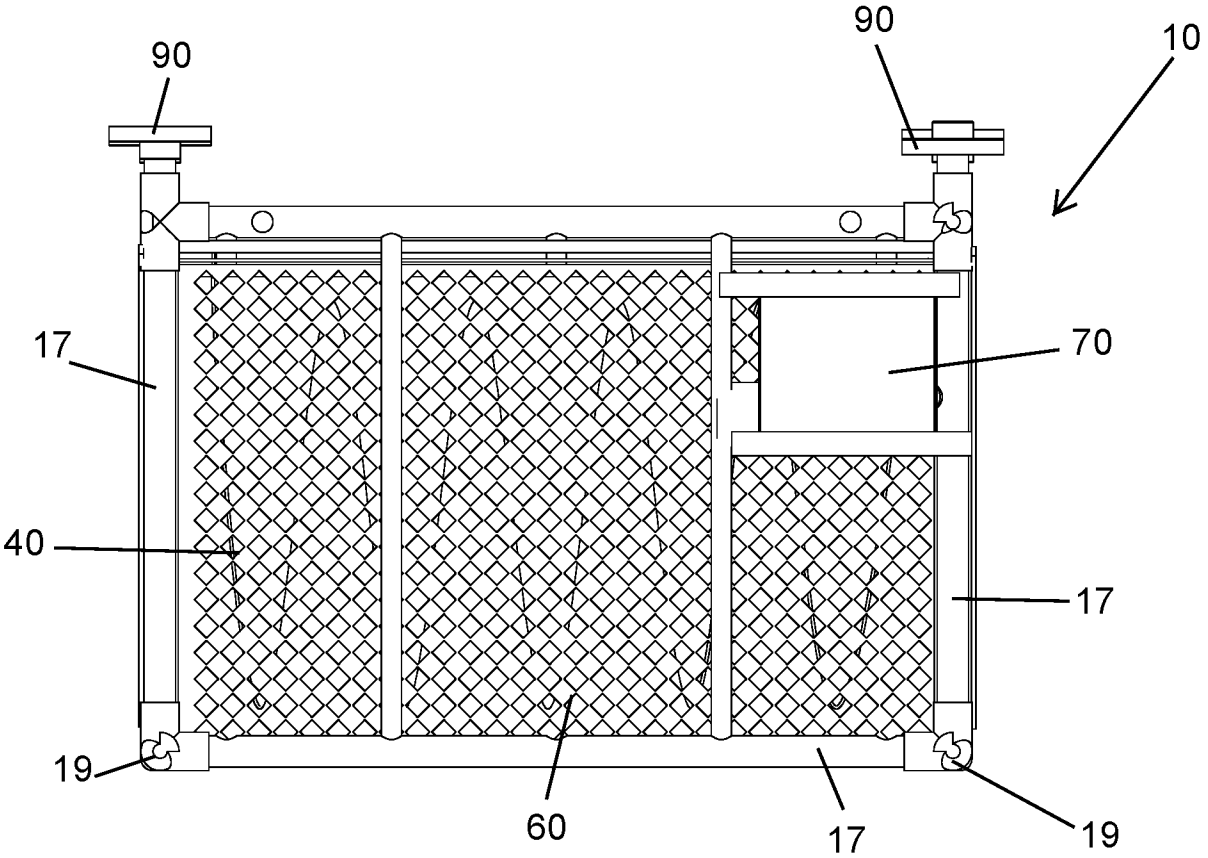
FIG. 10 is a top plan view of FIG. 7 where the cover is removed.
Figure 11:
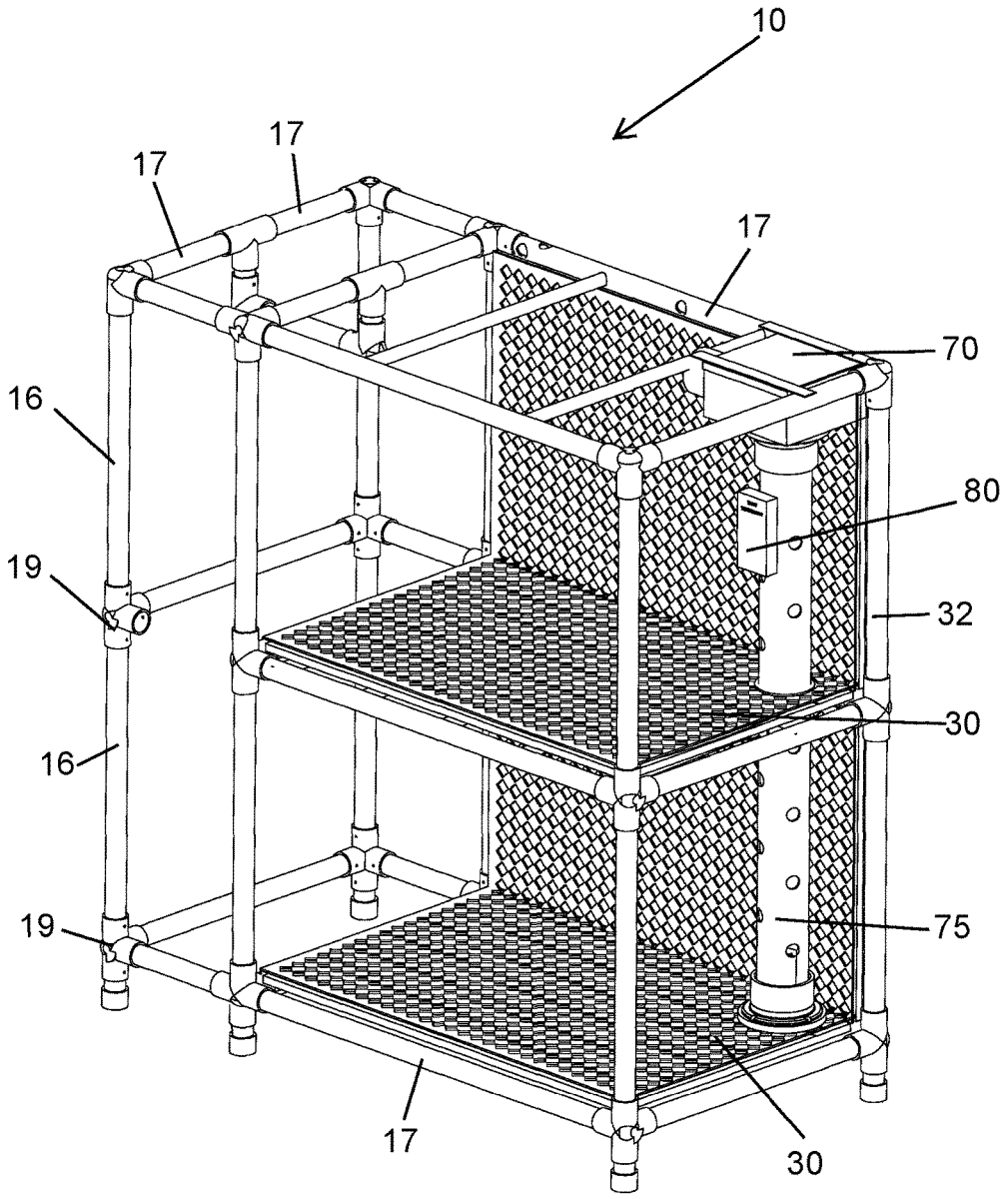
FIG. 11 is a top front perspective view of a third embodiment of the drying container where the cover is removed.

As shown in FIGS. 1 and 7, cover 50 forms a back wall (not shown), a front wall 11, a top wall 12, and two side walls 13. The back, front 11, top 12, and side walls 13 define an internal compartment. According to at least one example embodiment, the storage container 10 is configured to be sized and shaped to ensure that the internal compartment is large enough to hold objects such as, outerwear, sports clothing and equipment stored within a athletic bag, such as a hockey bag.

Referring in particular to FIGS. 1 and 7 which depict two embodiments of the storage container 10. As shown, cover 50 covers a substantial portion of the vertical and top portion of frame 15. In this manner, cover 50 can be easily placed over frame 15 for use.

Cover 50 can be made from non-woven polyester, woven polyester and cotton/polyester blends. Woven fabric is more durable than non-woven fabric, although both woven and non-woven fabric is within the scope of the invention. Woven fabric can be made from polyester, polyester/cotton mix or even 100% cotton. Although not wanting to be bound by any particular theory woven fabrics are more durable, than non-woven fabric. One additional benefit of a woven fabric is that it's typically washable.

Cover 50 may also include a binding material 55 where the fabric used to finish the edges of cover 50. Binding can be made from woven or non-woven fabric as well. Binding prevents the edges of cover 50 from fraying, thus increasing the life expectancy.

Referring now to FIGS. 2-6, where storage container 10 is configured with three horizontal panels 30 and three vertical panels 32 connected to frame 15. In at least this example embodiment, frame 15 may be made of plastic or metal tubing. In at least this example embodiment frame 15 may easily assembled and disassembled. The frame 15 is structured in a manner to allow horizontal panels 30 to form a shelf.

Figure 4:
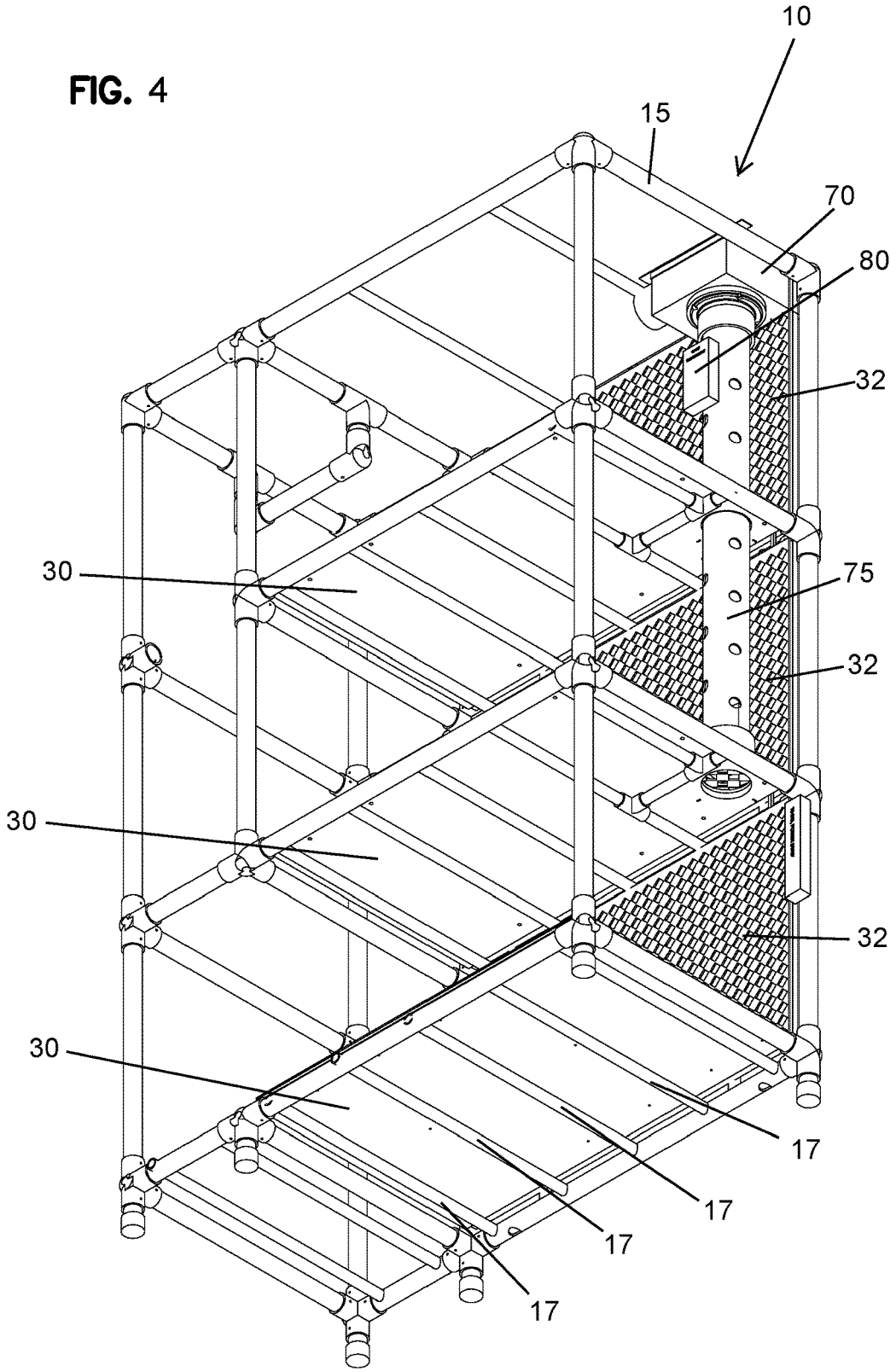
FIG. 4 is a bottom front perspective view of FIG. 1 where the cover is removed.
Figure 5:
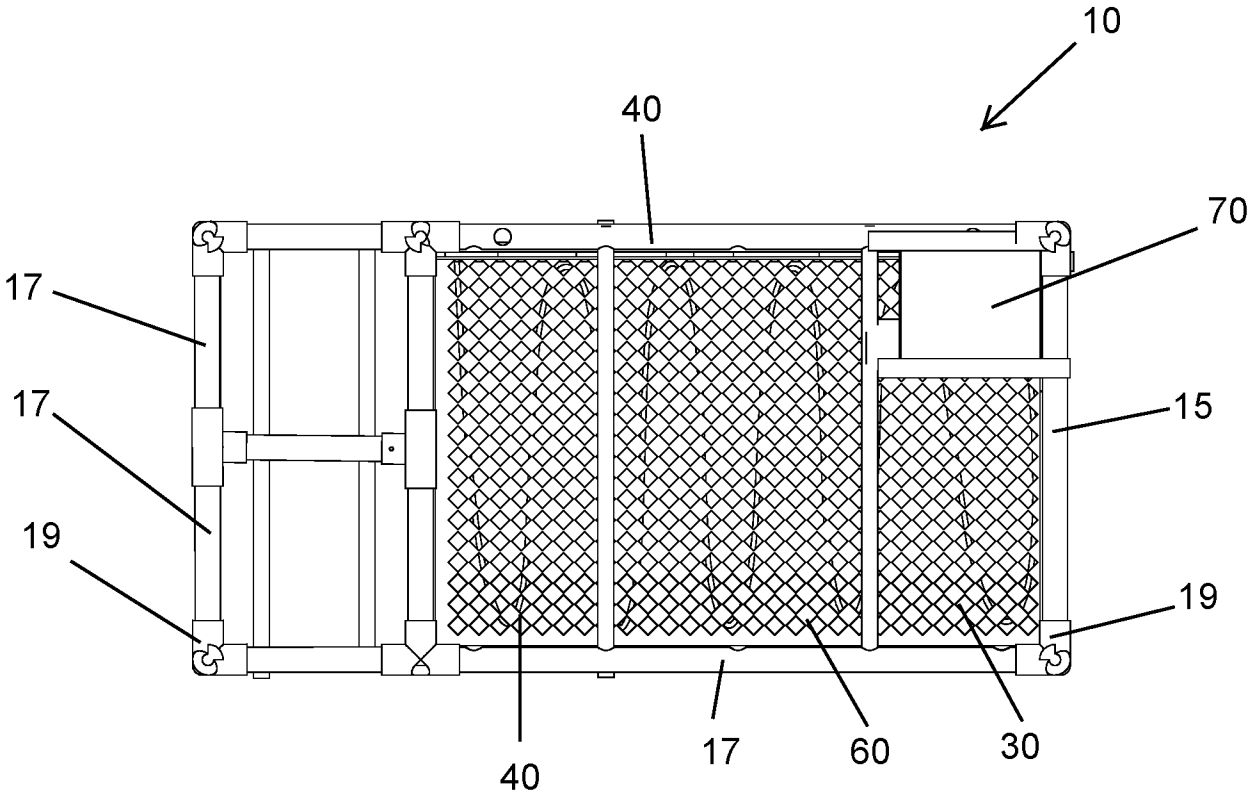
FIG. 5 is a top plan view of FIG. 1 where the cover is removed.

Referring now to FIGS. 2-11, where frame 15 is made up of a plurality of vertical frame segments 16 and horizontal frame segments 17 joined at frame junction 19. Each of the connections between frame segments may be assembled by mechanical means, such as bolts, screws or fasteners. Alternatively, frame segments may also be mechanically or chemically coupled. In addition segments 16, 17 can be connected by friction fit joints. It should be appreciated that each of the segments will form the general shape and size of the storage container 10. To that end, as best shown in FIG. 4, horizontal frame segments 17 provide structural support to the bottom of frame 15, but would not be covered by cover 50, when in use. Alternatively, referring now to FIG. 9, where the bottom of frame 15 is configured with horizontal frame segments 17, but this portion of frame 15 would be covered in use. In other related embodiments, frame 15 is adjustable so that the vertical and horizontal dimensions may be increased or decreased to adjust the overall size of the storage container 10.

Referring now to FIGS. 7-10 where frame 15 is integrally related to mounts. In at least this example embodiment, the storage container 10 can be attached to a wall. One of ordinary skill in the art would be able to determine the size and number of mounts to adequately attach storage container 10 to a wall.

In some examples embodiments frame 15 is constructed to support drying fan 70. Furthermore, it is also contemplated that the drying fan may be coupled to a circulation chamber 75. One of ordinary skill in the art would readily understand that the drying fan 70 may be placed in various positions within the internal compartments of storage container 10. It will be understood that according to at least this embodiment, the drying fan will need to be adapted to attach to frame 15.

Drying fan 70 is sized, shaped and positioned within the storage container 10 to help move air through the circulation chamber 75 and in particular, to encourage airflow throughout the internal compartment, such that the temperature outside of the sporting equipment bags would be substantially uniform and the locker uniform temp would be less than the air temperature in the bag. Circulation chamber 75 coupled to the intake side of drying fan 70. Circulation chamber provides a means to facilitate air circulation throughout storage container 10. In at least one example embodiment at least one circulation chamber comprises a vertical orientation within the internal compartment of storage container 10.

In related embodiments the airflow through circulation chamber moves from the bottom to the top of storage container. In an alternative embodiment, the drying fan 70 would be positioned near the bottom of the storage container 10. In at least this example embodiment, the airflow would circulate from the top of the circulation chamber 75 to the bottom, where the circulation chamber is again coupled to the drying fan 70. In at least each of these described embodiments, the circulation chamber will have more holes the further the distance from the drying fan 70 connection to force air intake along the circulation chamber to occur through all vertical sections of the storage container 10.

In other alternative embodiments circulation chamber 70 comprise a horizontal orientation coupled to a drying fan adjacent the right side of the storage container 10. In these example embodiments the airflow through circulation chamber moves from the left side to the right side of storage container. In an alternative embodiment, the drying fan 70 would be positioned near the left side of storage container 10. In at least this example embodiment, the airflow would circulate from the right side of the circulation chamber 75 to the left side. In at least each of these described embodiments, the circulation chamber will have more holes the further the distance from the drying fan 70 connection to force air intake along the circulation chamber to occur through all horizontal sections of the storage container 10. In other related embodiments, circulation chamber 70 includes a filtration system to reduce the odors from used sporting equipment. While not wanting to be bounds by a particular method of filtration, one example filtration system is a charcoal filtration system.

One of ordinary skill in the art would readily understand that the internal compartment and the inside temperature of the bag would achieve equilibrium after an extended period of time. Most preferably the drying fan 70 should have a small profile in the internal compartment, to avoid limiting usable space within storage container 10. However, it should be appreciated that the drying fan 70 should provide sufficient movement of air within the internal compartment for the purpose of drying the contents placed therein.

It should be appreciated that they specific type of drying fan 70 will varying dramatically on the amount of airflow and energy consumption desired. For example, drying fan 70 may include a mechanism that uses a centrifugal fan system, similar to a fan used to ventilate bathrooms. In this manner a centrifugal system may measure at 50 CFM, while a circular fan may measure at 100 CFM. Thus, the desired ventilation and airflow will be readily determined by one of ordinary skill in the art in combination with the disclosure herein.

While some embodiments of the drying fan 70 are described as have a single fan, multiple fans may be used for storage container 10 embodiments with larger internal compartment areas. Fans and electric motors such as these are well known in the art and will therefore not be described in further detail.

The drying fan 70 may be controlled with a simple on/off switch or it may be outfitted with a programmable timer which may be set to turn off automatically after a set time or temperature has been achieved. It should further be appreciated that drying fan 70, must be appropriately sized to allow for proper air flow through circulation chamber 75. It is also contemplated that the number and locations of heating elements 40 will also be a factor in determining the proper drying fan 70 required. Preferably, the drying fan 70 is in communication with control box 80 for controlling the speed of the fan. Heating elements should be spaced to avoid localization of heat; such that the heating elements will heat the adjacent panels (i.e. 30 and/or 32), but not create large discrepancies in temperature between various portion of, for example mesh substrate 92. The heating element 40 can be adjusted from 40 degrees to 108 degrees surface temp with the thermostat, which may optionally include a regulator. The regulator can be connected to or housed within the heating element 40 to provide a safety mechanism to limit the amount of current through the coil, therefore limiting the heat output. Unlike other heated storage lockers and the like, the heating element 40 can achieve desired results due to such a large amount of heated surface area.

Referring specifically to FIGS. 2, 3, 4, 6, 8, 9 and 11, where storage container 10 comprises control box 80 that is electrically connected to heating elements 40. Control box 80 generally includes a thermostat for temperature control. In addition, control box 80 may optionally comprise a humidistat that senses the humidity of the air in storage container 10. When the temperature or humidity in the storage container is below a selected limit, control box will initiate heating element 40 to turn on. Conversely, once a particular temperature is achieved control box 80 will terminate the power to the heating system. The control box may also be connected to drying fan 70. It should be appreciated that the control box 80 allows for adjusting temperature, fan, humidity, time etc. to achieve a desired dryness in a set amount of time.

Mesh substrate 92 must be made of a material that has high heat conductivity. In one example embodiment, mesh substrate 92 comprises steel. One of ordinary skill in the art would be able to determine an adequate material, including metal and metal alloys that have proper heat capacity for use in storage container 10. Mesh substrate 92 must also include apertures; see for example FIGS. 2, 3, and 8, so the heat from heating element 40 does not localize, which could be a fire hazard.

Figure 6:
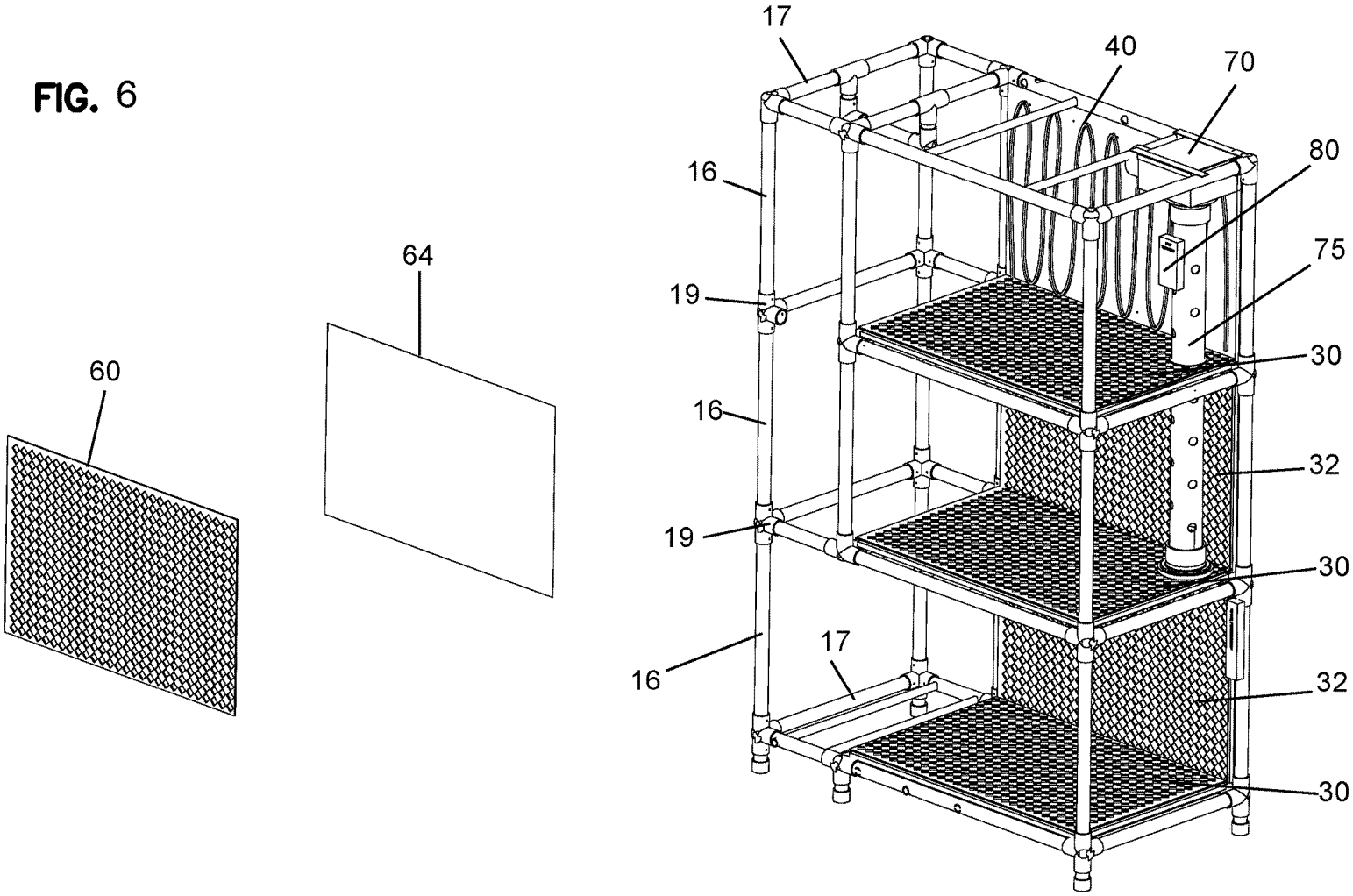
FIG. 6 is a front perspective view of FIG. 1. where the cover is removed with an exploded view of the top vertical panel.

As best illustrated in FIGS. 3, 5, 6, and 10, horizontal panels 30 and vertical panels 32 generally include a mesh sheet 60 that is fabricated in a manner to have apertures to allow for airflow between the panels 30, 32. Some panels 30 and 32 may further comprise a heating element 40. As best shown in FIG. 6, panels 30, 32 may further comprise a heat dispersion layer 64 between heating element 40.

This heat dispersion layer 64 should comprise a material that allows for heat to dispersion substantially evenly to the mesh substrate 92. One such material includes an aluminum facing to spread the heat load, so as to not localize the heat and burn the heat dispersion layer 64. In other related embodiments, the heating element may optionally include heating element 40 and mesh substrate 92, may also comprise heat resistant plastic edging which will prevent deformation under operation temperature. In some example embodiments, the panel (30 and/or 32) adjacent to heating element 40 may include an additional insulation layer. In one example embodiment, the insulation layer is between the heating element 40 and cover 50 when storage container 10 is in use. In alternative embodiments, the insulation is between the panel (30 and/or 32) and heating element 40. In other embodiments, where heat dispersion layer 64 is included, the insulation may be between the heating element 40 and the heat dispersion layer 64. In other embodiments, where heat dispersion layer 64 is included, the insulation may be between the heat dispersion layer 64 and mesh substrate 92. The insulation is particularly beneficial for use to maintain optimal heating, in particular when outdoor areas are below freezing. For example, if the storage container 10 is adjacent to a garage wall that has a surface temperature of 0 degrees Fahrenheit, the use of an insulation layer(s) would provide improved results.

When in use, cover 50 is removed and a sports equipment bags, with the equipment contained therein, are positioned on a shelf 30. The control box 80 is set to preferred parameters and cover 50 is placed back over frame 15. The sports equipment bag being directly positioned on shelf panels 30 which have heating elements connected thereto will allow the internal environment of the sports equipment bag to increase in temperature at a rate faster than other areas of the internal compartment of storage container 10. Articles, such as clothing, shoes, skates and gloves will dry without the need to remove the equipment from the sports equipment bag. In addition the sport equipment bag may remain closed and still be able to achieve desired dryness.

In one example, the control box is turned on and the heating element(s) 40 begin to heat sports equipment bags. After 4-6 hours, or alternatively after 6-10 hours, the equipment within the closed sports equipment bag(s) will be dry and ready for use. In other embodiments the equipment bags contained within the storage container 10 will reach equilibrium, equipment and bags will be dry in 8-12 hours, or shorter.

It should be appreciated that the storage container 10 described herein may be used in external temperatures below freezing. In some examples embodiments, the external temperature may be below 15 degrees Fahrenheit. In other example embodiments, the external temperature may be below 10 degrees Fahrenheit. In other example embodiments, the external temperature may be below 5 degrees Fahrenheit. In other example embodiments, the external temperature may be below 0 degrees Fahrenheit. In other example embodiments, the external temperature may be −10 degrees Fahrenheit or higher. Thus, the storage container 10 described herein can be used in garages, storage sheds, carports and the like and avoid the need to take up living areas within a residence.

In addition the sports equipment does not need to be brought into the residence to be dried, thereby eliminating the malodorous equipment. In addition, the equipment does not need to be removed from the sports equipment bag, thereby reducing the chance of misplaced equipment prior to the next use. It is possible to use fewer heaters than there are shelves in the frame 15. Alternatively, the heating elements may be associated with the vertical panels 32. The invention could be used to keep things besides sports equipment warm. For example, the storage container described herein may be used on construction site for equipment that cannot freeze.

It should be appreciated that the power supply to operate storage container 10 can include a power cord for use in a standard residential outlet. The power supply may optionally include additional outlets, similar to a power cord. This device could also be made mobile and run off of DC current instead of 120V AC.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A storage container comprising:

a frame;

at least one panel, thereby forming a shelf;

a heating element, wherein the heating element is capable of radiant and/or conductive heat; and a cover, sized to fit over the frame, thereby forming an internal compartment, wherein the storage container is configured to reduce moisture or dry contents placed therein.

2. The storage container of claim 1, wherein the frame comprises a material selected from a group consisting of polyethylene, polypropylene, polyvinyl chloride and combinations thereof.

3. The storage container of claim 1, wherein one or more components are manufactured from steel or one or more components are made of silicone rubber material.

4. The storage container of claim 1, further comprising a plurality of mounts connected to the frame and sized for attaching the storage container to a wall.

5. The storage container of claim 1, wherein the cover is of woven fiber with high thermal insulating properties and low conductive surfaces.

6. The storage container of claim 1, wherein the frame is adjustable to increase or decrease the internal area of the storage container.

7. The storage container of claim 1 wherein the heating element comprises a thermostat that is in communication with the heating element, thereby altering the BTU output in response to temperature changes of the internal compartment.

8. The storage container of claim 1, further comprising a circulation chamber.

9. The storage container of claim 8, wherein the circulation chamber is connected to a fan.

10. The storage container of claim 9, where the fan is a circular fan or a centrifugal fan.

11. The storage container of claim 1, further comprising at least one vertical panel.

12. The storage container of claim 1 or claim 11, wherein the panel comprises at least two substrates, wherein each of the at least two substrates are made with different materials.

13. The storage container of claim 12, wherein the heating element is integrally related to at least one horizontal panel or at least one vertical panel.

14. The storage container of claim 1, wherein the frame is a plurality of vertical and horizontal segments that can be removably attached to one another.

15. The storage container of claim 1, wherein the cover further comprises a mechanism for allowing access to the internal compartment without needing to remove the entire cover from the frame.

16. The storage container of claim 1, wherein the heating element is capable of radiant and conductive heat.

17. The storage container of claim 1, wherein the heating element allows for equipment to be stored in a sports bag within the storage container and when the sports bag is placed on the shelf, the internal environment of the sports bag will heat faster than the external environment of the sports bag.

18. The storage container of claim 1, wherein the cover comprises a window for viewing the internal compartment of the storage container.

* * * * *